US007716936B2

(12) United States Patent
Bailey et al.

(10) Patent No.: US 7,716,936 B2
(45) Date of Patent: May 18, 2010

(54) METHOD AND APPARATUS FOR AFFECTING DEFROST OPERATIONS FOR A REFRIGERATION SYSTEM

(75) Inventors: Patrick M. Bailey, Snellville, GA (US); Ira Zelman Richter, Lilburn, GA (US); Donald Victor McNemar, Lawrenceville, GA (US)

(73) Assignee: Heatcraft Refrigeration Products, L.L.C., Stone Mountain, GA (US)

( * ) Notice: Subject to any disclaimer, the term of this patent is extended or adjusted under 35 U.S.C. 154(b) by 425 days.

(21) Appl. No.: 11/475,295

(22) Filed: Jun. 26, 2006

(65) Prior Publication Data

US 2007/0295015 A1 Dec. 27, 2007

(51) Int. Cl.
*F25D 21/06* (2006.01)
*F25D 21/00* (2006.01)
*F25D 19/00* (2006.01)

(52) U.S. Cl. ..... 62/151; 62/80; 62/155; 62/298

(58) Field of Classification Search ..... 62/151, 62/155, 80, 298, 81, 82
See application file for complete search history.

(56) References Cited

U.S. PATENT DOCUMENTS 4,142,374 A 3/1979 Ansted et al.
4,327,557 A 5/1982 Clarke et al.
4,384,462 A * 5/1983 Overman et al. ..... 62/175
5,295,361 A 3/1994 Novak et al.
5,363,669 A 11/1994 Janke et al.
5,454,230 A 10/1995 Janke et al.
5,469,715 A 11/1995 Janke et al.
5,483,804 A * 1/1996 Ogawa et al. ..... 62/153
5,493,867 A 2/1996 Szynal et al.
2002/0020175 A1 * 2/2002 Street et al. ..... 62/132
2005/0183427 A1 * 8/2005 Dudley et al. ..... 62/80

* cited by examiner

*Primary Examiner*—Frantz F. Jules
*Assistant Examiner*—Daniel C Comings

(57) ABSTRACT

A method for affecting a scheduled defrost operation for a refrigeration system includes the steps of: (a) after an extant the scheduled defrost operation commences, evaluating at least one predetermined parameter relating to operation of the refrigeration system; (b) if the at least one predetermined parameter manifests a behavior of at least one first predetermined nature over at least one first time interval, continuing the extant scheduled defrost operation; and (c) if the at least one predetermined parameter manifests a behavior of at least one second predetermined nature over at least one second time interval, discontinuing the extant scheduled defrost operation.

19 Claims, 8 Drawing Sheets

METHOD AND APPARATUS FOR AFFECTING DEFROST OPERATIONS FOR A REFRIGERATION SYSTEM

BACKGROUND OF THE INVENTION

The present invention is directed to control of defrost operations for refrigeration systems, including electrically operated heat pump systems, and especially to controlling scheduled defrost operations for a refrigeration system or an electrically operated heat pump system.

Many commercial refrigeration systems employ electromechanical relay timed control devices to schedule the start and control the termination of evaporator coil defrost operations. Many electrically operated heat pumps use similar timed control devices to defrost a heat exchanger outside of an air conditioned space when the heat pump is in a heating mode. For purposes of this disclosure the term "refrigeration systems" also is intended to include electrically operated heat pumps which use electric resistance heaters, microwave energy, or another electrically generated heat source to defrost a heat exchanger outside of an air conditioned space when operating in a heating mode. The timed control devices may be configured to be programmed to initiate a defrost operation at varied and multiple times throughout a day. The timing for defrost operations is typically specified by the needs of the application in which the particular refrigeration system is employed and by knowledge of the manufacturer or installer of the refrigeration system. The timed control devices may control the termination of a defrost process either upon receiving a signal from a temperature or pressure sensing device or upon lapsing of a maximum allowed time that may be pre-programmed in the timed control device. Once programmed, the timed control devices will typically activate the defrost operation in a consistent and repeating manner, regardless of the actual condition of the evaporator coil.

The manufacturer or installer must choose the appropriate number of defrosts, and the maximum allowed time for each defrost based upon knowledge of the application and type of equipment being used. Such design choices are sometimes based upon a worst-case scenario that the refrigeration system may be expected to encounter on a day-to-day basis. As a result of such a loose predictive selection method, the refrigeration system may defrost itself more times than is necessary on days not presenting the predicted worst-case scenario. Resulting additional defrosts in such environments are typically a waste of energy, and thus a waste of money. In addition, such additional defrost operations may put refrigerated products at risk of spoilage.

Redesigning a defrost control device for a refrigeration system may be expensive, especially in the case of already installed refrigeration systems.

There is a need for a defrost control method and apparatus that can be added to an existing refrigeration system to achieve control of defrost operations for a refrigeration system that is responsive to contemporaneous conditions rather than responsive to predicted environmental conditions.

There is a need for a method and apparatus for affecting defrost operations for a refrigeration system that is capable of analysis of performance of a refrigeration system and using results of the analysis to truncate a scheduled defrost operation when the method or apparatus determines that the defrost cycle is not required.

SUMMARY OF THE INVENTION

A method for affecting a scheduled defrost operation for a refrigeration system includes the steps of: (a) after an extant the scheduled defrost operation commences, evaluating at least one predetermined parameter relating to operation of the refrigeration system; (b) if the at least one predetermined parameter manifests a behavior of at least one first predetermined nature over at least one first time interval, continuing the extant scheduled defrost operation; and (c) if the at least one predetermined parameter manifests a behavior of at least one second predetermined nature over at least one second time interval, discontinuing the extant scheduled defrost operation.

An apparatus for affecting defrost operations for a refrigeration system includes: (a) A data collection and storage unit coupled with the refrigeration system. The data collection and storage unit acquires collected data from the refrigeration system during or after successive defrost operations of the refrigeration system. The data collection and storage unit stores at least a portion of the collected data as stored data. (b) An evaluation unit coupled with the data collection and storage unit. The evaluation unit operates after an extant scheduled defrost operation commences to effect evaluation of at least one predetermined aspect of at least a portion of the stored data relating to operation of the refrigeration system. (c) A control unit coupled with the evaluation unit and coupled with the refrigeration system. The control unit cooperates with the refrigeration system to effect continuing the extant scheduled defrost operation if the at least one predetermined aspect of the stored data manifests a behavior of at least one first predetermined nature over at least one first time interval. The control unit cooperates with the refrigeration system to effect discontinuing the extant scheduled defrost operation if the at least one predetermined aspect of the stored data manifests a behavior of at least one second predetermined nature over at least one second time interval.

It is, therefore, an object of the present invention to provide a defrost control method and apparatus that can be added to an existing refrigeration system to achieve control of defrost operations for a refrigeration system that is responsive to contemporaneous conditions rather than responsive to predicted environmental conditions.

It is a further object of the present invention to provide a method and apparatus for affecting defrost operations for a refrigeration system that is capable of analysis of performance of a refrigeration system and using results of the analysis to truncate a scheduled defrost operation when the method or apparatus determines that the defrost cycle is not required.

Further objects and features of the present invention will be apparent from the following specification and claims when considered in connection with the accompanying drawings, in which like elements are labeled using like reference numerals in the various figures, illustrating the preferred embodiments of the invention.

DETAILED DESCRIPTION OF THE PREFERRED EMBODIMENT

The word "or'" is employed throughout this description to indicate that an inclusive relation applies between terms or among terms. For example, the expression "A or B" intends to describe the relationship (1) A, or (2) B or (3) A and B.

Figure 1:
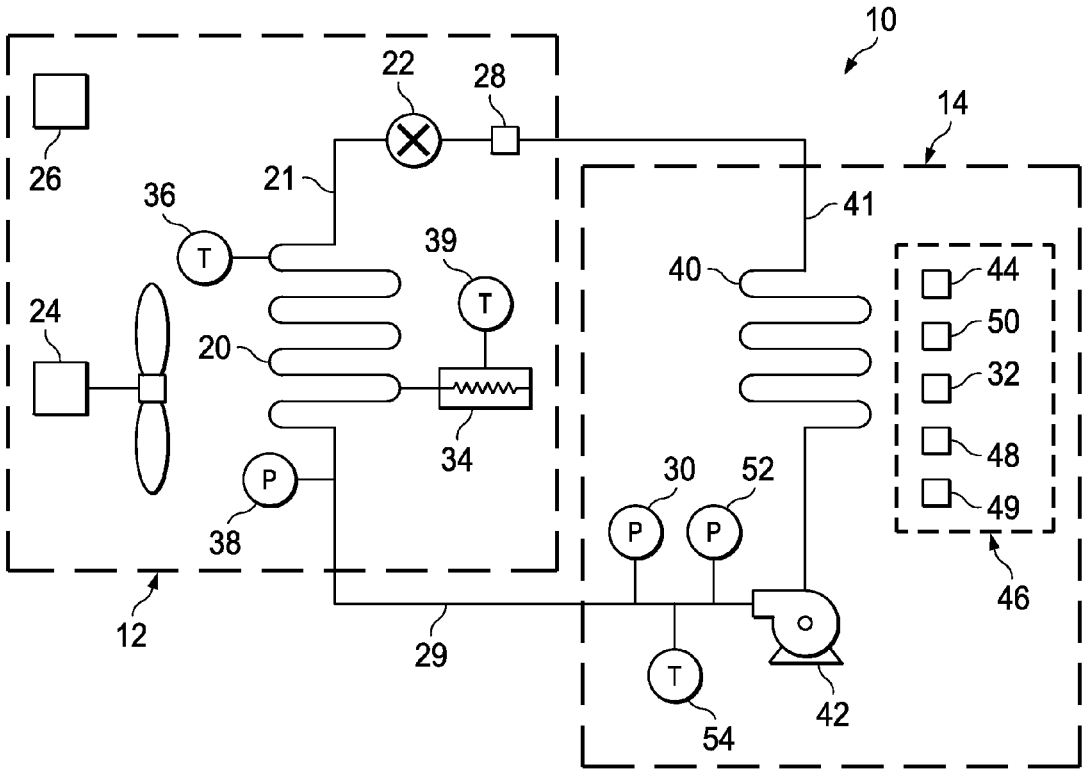
FIG. 1 (PRIOR ART)
FIG. 1 is a schematic diagram of a refrigeration system installed for cooling a space.

FIG. 1 is a schematic diagram of a refrigeration system installed for cooling a space. In FIG. 1, a refrigeration system 10 (sometimes referred to as a cooling system) includes equipment in an indoor space 12 and equipment in an outdoor space 14. Equipment in indoor space 12 includes an indoor space heat exchanger or evaporator 20. Equipment in outdoor space 14 includes an outdoor heat exchanger or condenser 40. A circulating device or compressor 42 is coupled with or condenser 40 and with evaporator 20 to effect circulating of a heat transfer fluid or coolant (not shown in detail in FIG. 1) between evaporator 20 and condenser 40. A regulating device or expansion valve 22 is located between outlet side 41 of condenser 40 and inlet side 21 of evaporator 20 for regulating the rate of flow of coolant through evaporator 20. A fan 24 is situated in indoor space 12 for directing ambient air in indoor space 12 across evaporator 20 to effect cooling of the ambient air. Evaporator 20 and condenser 40 are each configured for operation as heat transfer units, preferably in multiple pass coil structures.

A temperature control unit 26 is located within indoor space 12 for controlling operation of refrigeration or refrigeration system 10. Temperature control unit 26 may be embodied in a thermostat, pressure switch, or another control mechanism. The control of refrigeration system 10 is preferably carried out as follows: when air temperature within indoor space 12 rises above a predetermined temperature set point, temperature control unit 26 activates a solenoid valve 28 to open and allow coolant to flow through expansion valve 22 and through evaporator 20. Details of connections among various portions and units of refrigeration system 10 are known by those skilled in the art of cooling system design. In order to avoid unnecessarily cluttering the drawings, those well-known connection details are omitted from the drawings. A low pressure refrigerant or coolant fluid in gaseous form is returned to condenser 40 from evaporator 20 through a suction line 29. A pressure switch 30 is coupled with suction line 29. Flow of coolant within suction line 29 causes pressure in suction line 29 to rise. Pressure switch 30 is activated when pressure in suction line 29 reaches a predetermined pressure level. A compressor contactor unit 32 is coupled with pressure switch 30 (connection details are not included in FIG. 1). When pressure switch 30 is activated, compressor contactor unit 32 is activated and a refrigeration process begins. When temperature in indoor space 12 (the refrigerated space) falls below a predetermined set point established by temperature control unit 26, then temperature control unit 26 causes solenoid valve 28 to close, thereby blocking coolant from passing through expansion valve 22 and evaporator 20. Compressor 42 continues to operate after solenoid valve 28 closes until pressure in suction line 29 drops low enough to cause pressure switch 30 to cause compressor contactor unit 32 to stop compressor 42. Generally, solenoid valve 28 closes in response to de-energizing solenoid valve 28.

A defrost time clock 44 is employed to control activation and termination of defrost operations for evaporator 20. Defrost time clock 44 is typically embodied in an electromechanical relay time clock or an electronic controller located in an electrical panel 46 coupled with equipment located in outdoor space 14. Defrost time clock 44 is sometimes referred to as the defrost timer. An evaporator fan contactor 48 is coupled with defrost time clock 44 and with fan 24 (connection details are not included in FIG. 1). Defrost time clock 44 controls activation of an evaporator fan contactor 48, compressor contactor unit 32 and a defrost heater contactor 49. Defrost heater contactor 49 is coupled to control operation of al 50 defrost heater 34 (connection details are not included in FIG. 1).

A temperature sensor 36 is coupled with evaporator 20 for sensing temperature of evaporator 20. A pressure sensor 38 is coupled with evaporator 20 for sensing pressure of coolant passing through evaporator 20. Either of temperature sensor 36 and pressure sensor 38 may provide a signal to defrost time clock 44 during a defrost process to indicate completion of the defrost process when temperature or pressure in evaporator 20 reaches a predetermined set point. A high temperature cutout switch 39 may be coupled with defrost heater 34 as an emergency back up sensor. Defrost heater 34 may be disconnected from power when high temperature cutout switch 39 senses a high temperature higher than a predetermined set point. Other parameters may also be employed, such as by way of example and not by way of limitation, rate of increase of temperature. Voltage is provided to operate defrost heater 34 when defrost time clock 44 activates defrost heater contactor unit 49. Evaporator fan 24 is energized when defrost time clock 44 activates evaporator fan contactor 48. As understood by those skilled in the art of refrigeration systems, an alternate control device such as a thermostat or time delay (not shown in FIG. 1) may be employed to delay operation of fan 24 until temperature of evaporator 20 has been lowered to a predetermined set point.

Defrost heater 34 is typically embodied in an electrically resistive heating element. Defrost heater 34 is periodically energized to produce heat so as to melt and thereby remove frost or ice that may have deposited on coils, fins or other heat transfer structures of evaporator 20. The process of periodically heating evaporator 20 is carried out to maintain effectiveness of heat transfer by evaporator 20. Defrost time clock 44 operates to control application of voltage to defrost heater 34 by activating defrost heater contactor 49. Defrost time clock 44 is pre-programmed to activate start of a defrost operation at specific times throughout a day. Pre-programming also often includes a maximum allowed defrost time in order to truncate a heating operation so as to avoid providing too much heat during a defrost cycle. Too much heat may damage defrost heater 34, evaporator 20 or other elements of refrigeration system 10. Pre-programming may be effected by a manufacturer, by an installing contractor or by other technical personnel familiar with operation and set-up of refrigeration system 10.

Completion of a defrost operation (sometimes referred to as a defrost cycle) is accomplished by either an elapsing of the pre-programmed maximum allowable defrost time or by an input signal provided at a reset input locus of defrost time clock 44 (not shown in detail in FIG. 1). The reset input locus is typically coupled for receiving signals from temperature sensor 36 indicating temperature of evaporator 20. When temperature sensor 36 indicates that evaporator 20 has reached a predetermined temperature during a defrost operation, temperature sensor 36 will provide a signal at a reset input locus of defrost time clock 44 to effect termination of the extant defrost operation. Optional high-temperature cut out switch 39 located in proximity with defrost heater 34 provides additional protection by providing a signal at a reset input locus of defrost time clock 44 if defrost heater 34 reaches a predetermined temperature. A useful embodiment of refrigeration system 10 employs a defrost time clock 44 having a double-pole contact that controls defrost heater contactor 49 (and, thus, controls defrost heater 34) and also controls evaporator fan contactor 48. In this double-pole configuration, when defrost time clock 44 is not activating a defrost operation, defrost time clock 44 is activating evaporator fan 24 and solenoid valve 28 to configure refrigeration system 10 for a cooling operation.

Defrost time clock 44 operates to carry out its pre-programmed cooling operation according to a refrigeration or cooling cycle.

Figure 2:
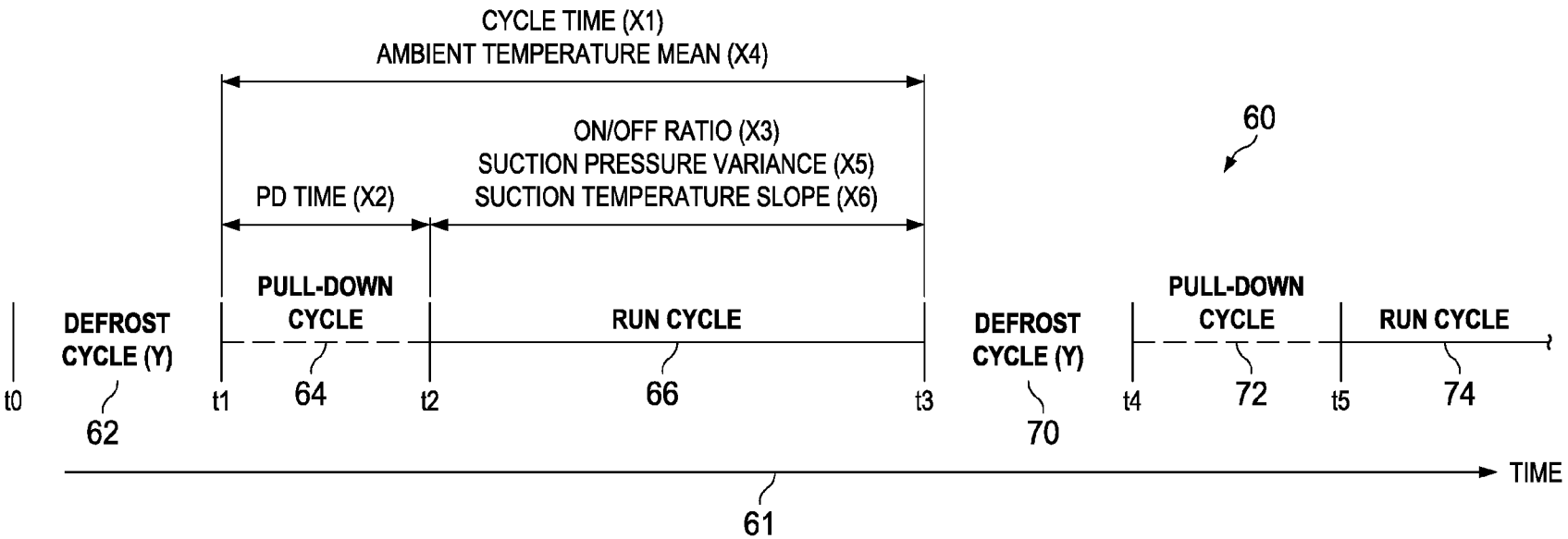
FIG. 2 (PRIOR ART)
FIG. 2 is a representation of timing for a representative refrigeration cycle.

FIG. 2 is a representation of timing for a representative refrigeration cycle. In FIG. 2, a graphic representation of a refrigeration cycle 60 is presented with respect to a horizontal axis 61 representing time. Refrigeration cycle 60 includes three main segments: a defrost cycle 62, a pull-down cycle 64 and a run cycle 66. Defrost cycle 66 commences at a time $t_0$ and spans a time interval $t_0$-$t_1$. Pull-down cycle 64 follows defrost cycle 62; pull-down cycle 64 begins at time $t_1$ and spans a time interval $t_1$-$t_2$. Duration of time interval $t_1$-$t_2$ for completion of pull-down cycle 64 is the time required to remove heat introduced into evaporator 20 and air surrounding evaporator 20 by defrost heater 34. This is an example of a continuous-run cycle that does not stop until the air temperature surrounding temperature control unit 26 (FIG. 1) has fallen below the temperature control unit set point.

Run cycle 66 follows pull-down cycle 64. Run cycle 66 begins at time $t_2$ and spans a time interval $t_2$-$t_3$. During time interval $t_2$-$t_3$ (run cycle 66) compressor 42 cycles on and off based upon temperature control unit 26 becoming satisfied. That is, based upon temperature control unit 26 falls below a predetermined set point. A simple refrigeration cycle 60 substantially repeats the cycle indicated during time interval $t_0$-$t_3$ so that refrigeration cycle 60 continues cyclically, as indicated by follow-on cycles: defrost cycle 70 spanning a time interval $t_3$-$t_4$, pull-down cycle 72 spanning a time interval $t_4$-$t_5$ and run cycle 74 continuing after time $t_5$.

Defrost cycle 62 is initiated by a defrost time clock 44 (FIG. 1). By way of example and not by way of limitation, prior to powering up refrigeration system 10 (FIG. 1), a manufacturer or an installing contractor places one or more pins onto pin positions of a timer wheel coupled with defrost time clock 44 (not shown in FIGS. 1-2). Each pin position represents a respective time of a day, so the pin installer can select how many defrost cycles are to occur each day and can establish when each respective defrost cycle will begin. A defrost cycle ends either when evaporator 20 (FIG. 1) reaches a predetermined temperature measured by temperature sensor 36 (FIG. 1), or when coolant in evaporator 20 reaches a predetermined pressure as measured by a pressure sensor 38 (FIG. 1) or after a predetermined maximum allowed time has elapsed since the start of the extant defrost cycle. If the total time of the extant defrost cycle is not determined by the elapsing of the maximum allowed time, variations in time of a respective defrost cycle duration may be attributed to differences in frost load of evaporator 20 prior to the start of the respective defrost cycle. An installing contractor or manufacturer typically takes into consideration a worst case day when programming a defrost schedule for a defrost time clock 44. As a result, whatever schedule is programmed for a defrost time clock 44 (e.g., by positioning pins in defrost time clock 44 as described above), defrost time clock 44 will faithfully execute the same number of defrosts each day according to its programming. This faithful adherence to a pre-programmed defrost schedule, regardless of real-time conditions, establishes the need fulfilled by the present invention.

The apparatus of the present invention is embodied in a defrost control unit 50 (FIG. 1) that may be coupled with defrost time clock 44, compressor contactor unit 32, a pressure transducer 52 and a temperature sensor 54 (connection details are not included in FIG. 1). Temperature sensor 54 may advantageously be embodied in a thermistor unit (details not shown in FIG. 1). Defrost time clock 44 operates according to its pre-programming to control starting and completion of defrost operations in refrigeration system 10. Defrost control unit 50 cooperates with defrost time clock 44 to preempt a defrost operation when it is determined that an extant defrost operation is not necessary. In order to effect the desired cooperation between defrost control unit 50 and defrost time clock 44, it is necessary to couple defrost control unit 50 with defrost time clock 44, as illustrated in FIG. 3.

Figure 3:
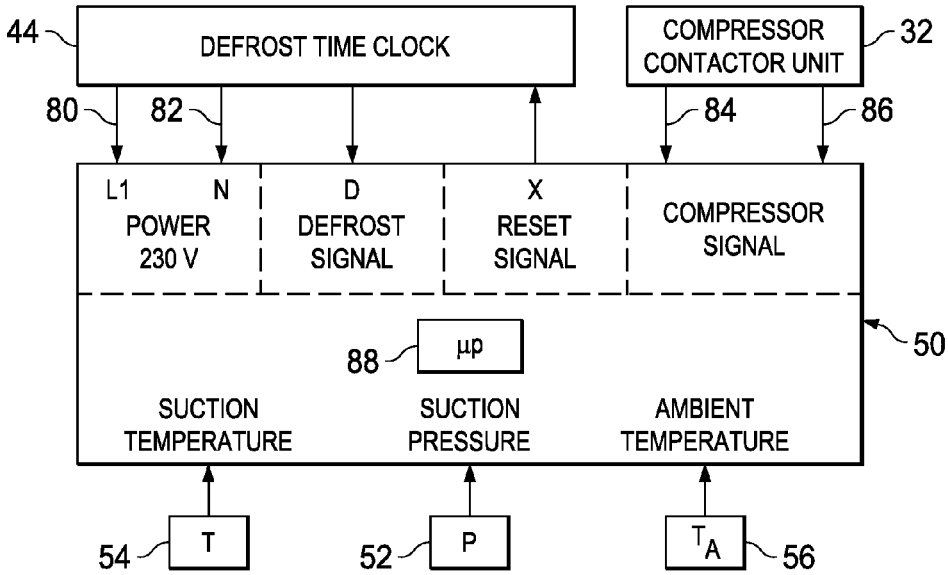
FIG. 3 (PRIOR ART)
FIG. 3 is a schematic diagram illustrating a representative connection of the apparatus of the present invention with an existing refrigeration system.

FIG. 3 is a schematic diagram illustrating a representative connection of the apparatus of the present invention with an existing refrigeration system. In FIG. 3, a defrost control unit 50 includes a power connection 80 and a ground connection 82 with defrost time clock 44 for providing power for defrost control unit 50. Defrost control unit 50 also is coupled to receive a signal D from defrost time clock 44. Signal D has a value greater than a predetermined signal level when refrigeration system 10 is providing power to evaporator fan 24. By way of example and not by way of limitation, signal D may have a value of 230 volts when refrigeration system 10 is providing power to evaporator fan 24. Defrost control unit 50 is still further coupled with defrost time clock 44 to provide a reset signal X to defrost time clock 44 to terminate a defrost operation. Defrost control unit 50 also is coupled with compressor contact unit 32 to receive compressor signals via signal lines 84, 86. Compressor signals are provided to defrost control unit 50 from compressor contactor unit 32 when compressor contactor unit 32 is energized, indicating that contactor unit 32 is trying to turn on compressor 42.

Defrost control unit 50 is also coupled with temperature sensor 54 to receive a signal indicating temperature in suction line 29. Defrost control unit 50 may also coupled with pressure sensor 54 to receive a signal indicating pressure in suction line 29. Defrost control unit 50 may also coupled with an ambient temperature sensor 56 (not shown in FIG. 1) to receive a signal indicating ambient temperature in or around outdoor equipment 14.

A microprocessor unit 88 is provided in defrost control unit 50 to control operation of defrost control unit 50. It is preferred that microprocessors unit 88 include appropriate programming and memory necessary to make decisions whether to skip a defrost cycle as it is activated by defrost time clock 44, as described below.

By way of example and not by way of limitation, defrost control unit 50 may be coupled electrically to coil voltage of compressor contact unit 32. In such a connected arrangement, defrost control unit 50 may observe a voltage of 230 VAC (Volts, Alternating Current) via lines 80, 82 when compressor 42 is activated. Signals received from defrost time clock 44 and compressor contactor unit 32 may be employed to ascertain the operational mode of refrigeration system 10, as indicated by way of example and not by way of limitation in Table 1 below:

TABLE 1

| Signal D | COMPRESSOR | SYSTEM MODE |
|---|---|---|
| 230 Volts | 230 Volts | COOLING |
| 230 Volts | 0 Volts | OFF |
| 0 Volts | — | DEFROST |

The third row of Table 1 indicates that when signal D is 0 Volts, refrigeration system 10 is in a defrost mode whatever the value of signals received at lines 84, 86 may be.

Temperature sensor 54 is coupled in refrigeration system 10 (FIG. 1) at suction line 29. The temperature in suction line 29 is employed to indicate refrigerant or coolant variations that may occur when evaporator 20 is iced and has lost control of superheat. Pressure sensor 52 is also coupled with suction line 29 and is used to indicate stability of pressure of coolant in suction line 29. When evaporator 20 is iced and expansion valve 22 is unable to properly control superheat, modulation of expansion valve 22 may cause pressure of coolant in suction line 29 to become unstable. Such pressure variations may be detected and indicated by pressure sensor 52. Ambient temperature sensor 56 indicates temperature of outside air which has a direct effect upon the capacity of refrigeration system 10. At higher ambient temperatures a typical refrigeration system has less capacity and it will tend to have longer run cycles, which can increase icing of its evaporator. Conversely, lower ambient temperature can increase capacity of the refrigeration system. This occurrence may also increase the rate of evaporator icing.

Microprocessor unit 88 is connected within defrost controller unit 50 to monitor input signals received via lines 80, 82, 84, 86; signal D; sensors 52, 54, 56 and output signal X to operate a program which has a purpose of determining whether an extant defrost cycle initiated by defrost time clock 44 should be terminated or truncated or should be allowed to continue. If microprocessor unit 88 determines that an extant defrost operation (i.e. a defrost operation begun according to pre-programming of defrost time clock 44) should be terminated, signal X may be sent to defrost time clock 44 to reset defrost time clock 44. This early resetting of defrost time clock 44 has the effect of "fooling" defrost time clock 44 into believing that the defrost termination temperature, or defrost termination pressure or another defrost termination criterion has been achieved. As a result, the defrost process is terminated substantially immediately as it begins.

The amount of time required to raise the temperature of evaporator 20 to a preset termination temperature (or pressure) is usually related to the amount of frost that has been deposited on the coil of evaporator 20 prior to the start of a defrost operation. By measuring and recording defrost times over a period of days and weeks, natural variations seen in the defrost elapsed times can give an indication when the evaporator 20 was iced and when evaporator 20 was not iced. If some specific input indicator variables are measured and recorded prior to the start of respective defrost cycles, one may be able to determine whether the measured input variables have some correlation to observed respective defrost times. Once a correlation is established and verified, the correlation can be used to predict a future defrost time just as the defrost cycle period is beginning. If the predicted defrost cycle time supports the conclusion that evaporator 20 is probably not iced, then that extant defrost cycle may be skipped. This is the basis of the control algorithm employed by the present invention.

Figure 4:
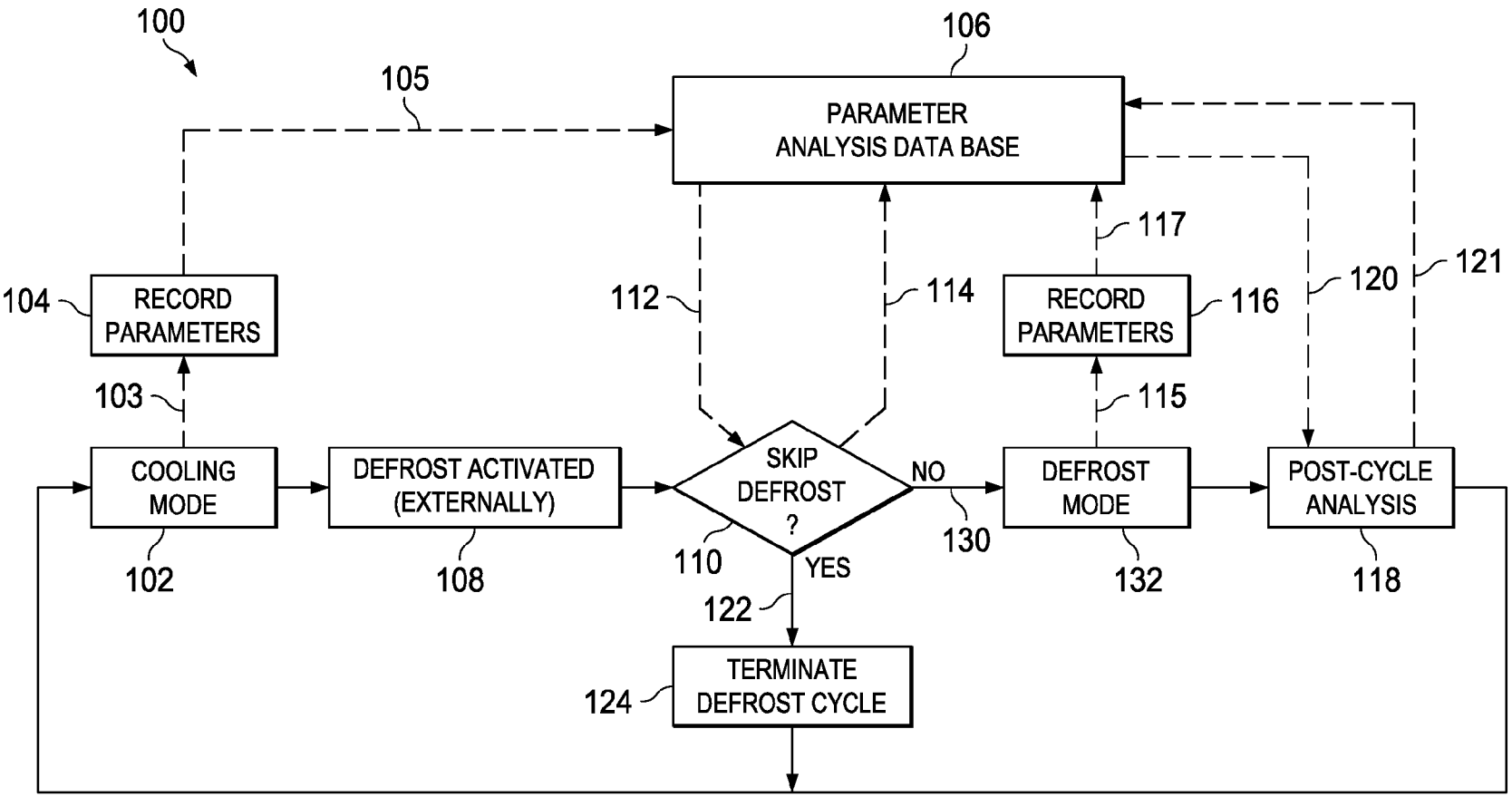
FIG. 4 is a schematic diagram illustrating the method of the present invention.

FIG. 4 is a schematic diagram illustrating the method of the present invention. In FIG. 4, a method 100 for affecting defrost operations for a refrigeration system begins with the refrigeration system in a cooling mode as indicated by a block 102. During the cooling mode indicated by block 102, method 100 effects collection and recording or predetermined parameters, as indicated by a dotted line 103 and by a block 104. The collected and recorded parameters may be saved in a parameter analysis data base 106 as indicated by a dotted line 105.

Method 100 next enters a defrost operation, as indicated by a block 108. The defrost operation indicated by block 108 is initiated externally of method 100, such as by a pre-programmed schedule in a defrost time clock (e.g., defrost time clock 44; FIG. 1). After initiation of the defrost operation indicated by block 108, method 100 evaluates whether to skip the extant defrost operation indicated by block 108, as indicated by a query block 110. Evaluation is effected in cooperation with analysis carried out using collected and recorded parameters saved in parameter analysis data base 106. Other parameters may be recorded and saved in parameter analysis data base 106 during the extant defrost operation indicated by block 108 in the evaluation, as indicated by dotted lines 112, 114. Parameters collected during earlier defrost operations (as indicated by dotted lines 115, 117 and block 116) may also be recorded and saved in parameter analysis data base 106. Still other parameters collected between earlier defrost operations (as indicated by a block 118 and dotted lines 120, 121) may be recorded and saved in parameter analysis data base 106. Any of the recorded and saved parameters in parameter analysis data base 106 may be employed in the evaluation (indicated by block 110) whether to skip the extant defrost operation (indicated by block 108).

If the evaluation indicated by block 110 concludes that the extant defrost operation indicated by block 108 should be skipped, method 100 proceeds via YES response line 122 and deactivates or terminates the extant defrost operation, as indicated by a block 124. Method 100 thereafter returns to a cooling mode, indicated by block 102. If the evaluation indicated by block 110 concludes that the extant defrost operation indicated by block 108 should not be skipped, method 100 proceeds via NO response line 130 and continues in defrost mode to complete the extant defrost operation, as indicated by a block 132. Method 100 thereafter effects post-cycle analysis to collect and record predetermined parameters, as indicated by block 118. Method 100 then returns to a cooling mode, indicated by block 102.

Evaluation effected pursuant to answering the query posed by query block 110 may, by way of example and not by way of limitation, involve determining whether the evaluated data manifests a behavior of at least one first predetermined nature over at least one first predetermined time interval, and if the data manifests a behavior of at least one first predetermined nature over at least one first predetermined time interval, continuing the extant defrost operation, as indicated by block 132. Evaluation effected pursuant to answering the query posed by query block 110 may, by way of example and not by way of limitation, further involve determining whether the evaluated data manifests a behavior of at least one second predetermined nature over at least one second predetermined time interval, and if the evaluated data manifests a behavior of at least one second predetermined nature over at least one second predetermined time interval, discontinuing the extant defrost operation, as indicated by block 124.

Figure 5:
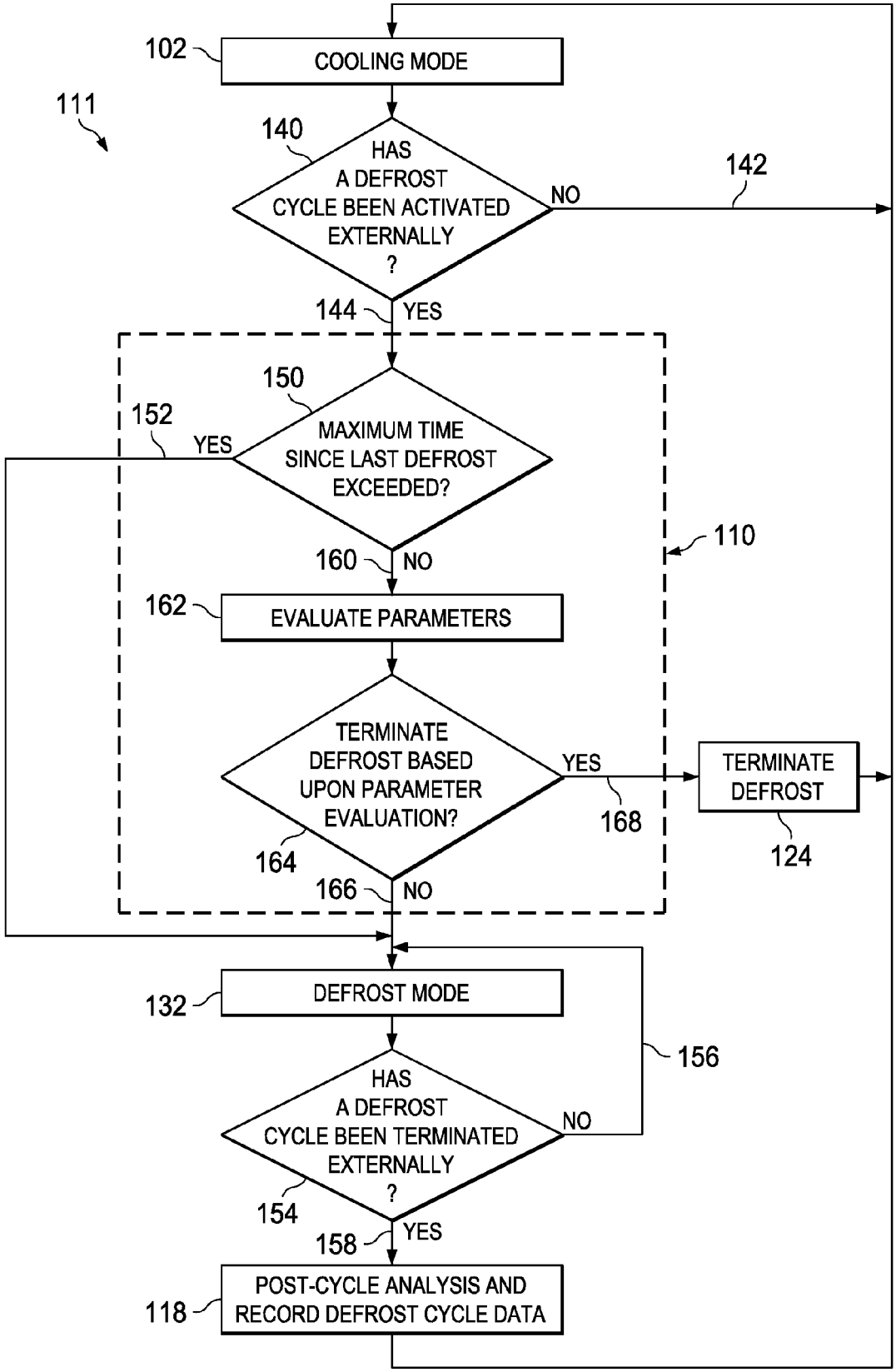
FIG. 5 is a flow chart illustrating details of a portion of the diagram of FIG. 4.

FIG. 5 is a flow chart illustrating details of a portion of the diagram of FIG. 4. In FIG. 5, a process 111 illustrates detailed steps relating to execution of method 100 (FIG. 4), in particular indicating details of effecting query block 110 of method 100. Process 111 may be first regarded while the refrigeration system is in a cooling mode, as indicated by a block 102 (also see FIG. 4). A query is then posed whether a defrost cycle or operation has been activated externally, as indicated by a query block 140. If no defrost cycle has been activated externally, process 111 proceeds via NO response line 142 and the refrigeration system remains in a cooling mode, as indicated by block 102. If a defrost cycle has been activated externally, process 111 proceeds via YES response line 144 and a query whether to skip the extant defrost operation is posed, as indicated by query block 110 (also see FIG. 4).

Pursuant to executing query block 110, a query is posed whether a predetermined maximum time has elapsed since the last defrost operation was completed, as indicated by a query block 150. If the predetermined maximum time has elapsed since the last defrost operation was completed, process 111 proceeds via a YES response line 152 and the defrost mode is continued, as indicated by block 132 (also see FIG. 4).

A query is then posed whether the extant defrost cycle has been terminated externally, as represented by a query block 154. If the extant defrost cycle has not been terminated externally, process 111 continues via NO response line 156 and the extant defrost cycle continues (block 132). If the extant defrost cycle has been terminated externally, the process continues via YES response line 158 and post-cycle analysis is carried out to collect and record predetermined parameters, as indicated by block 118 (also see FIG. 4). The process then returns to a cooling mode, indicated by block 102.

If the predetermined maximum time has not elapsed since the last defrost operation was completed, process 111 proceeds from query block 150 via a NO response line 160 and an evaluation of predetermined parameters is effected, as indicated by a block 162. A query is then posed whether the parameter evaluation effected according to block 162 indicated the extant defrost operation should be terminated, as indicated by a query block 164. If the parameter evaluation effected according to block 162 indicated the extant defrost operation should not be terminated, process 111 continues via a NO response line 166 and the extant defrost operation continues (block 132). The process continues thereafter from block 132 as described earlier herein in connection with FIG. 5 until process 111 returns to a cooling mode, indicated by block 102. If the parameter evaluation effected according to block 162 indicated the extant defrost operation should be terminated, process 111 continues via a YES response line 168 and the extant defrost operation is terminated (block 124; also see FIG. 4). Thereafter, process 111 returns to a cooling mode, as indicated by block 102.

By way of example and not by way of limitation, in a preferred embodiment, evaluation of defrost operations to evaluate whether to terminate an extant defrost operation or cycle employs a control algorithm using six input variables ($X_n$) in a multiple linear regression against the defrost cycle length (Y). Variables $X_n$ are identified in FIG. 2. Each one of these variables $X_n$, or variations of these variables $X_n$ either independently or in combination with other variables may indicate evaporator frosting. Variable $X_1$ is the total cycle time from the start of pull-down to the start of the next defrost; represented by time interval $t_1$-$t_3$ in FIG. 2.

The longer the time elapsed between defrost cycles, the more likely there will be frost deposited on evaporator 20 (FIG. 1), especially if the defrost cycle start times are irregularly spaced.

Variable $X_2$ is the length of time it takes to pull down (pull down cycle 64) after a defrost cycle; represented by time interval $t_1$-$t_2$ in FIG. 2. Variable $X_2$ could have an effect on the amount of frost deposited on evaporator 20. When compared to other pull down times, a longer cycle could indicate a door left open to indoor space 14, or a load introduced during a defrost cycle.

Variable $X_3$ is an on-off ratio during run cycle 66 (time interval $t_2$-$t_3$ in FIG. 2) that follows pull down cycle 64. Refrigeration system 10 turns on and off based upon the set point established by temperature control unit 26 (FIG. 1). The ratio of 'On' times to 'Off' times is recorded during this time period. A higher value indicates that compressor 40 had to operate longer to remove the heat within refrigerated indoor space 14. This could be because evaporator 20 is iced. An iced evaporator would have less ability to transfer heat, and thus the 'On' times would become longer. Variable $X_4$ is the outside air temperature (ambient temperature). Variable $X_4$ can effect the operation of refrigeration system 10 because ambient temperature has a direct impact on the capacity of condenser 40. With a higher ambient temperature, it would take longer to remove the same amount of heat out of refrigerated indoor space 14 then when the outside air is cooler. The additional run time could add more frost to evaporator 20. Similarly, a much lower ambient air temperature could significantly increase the overall capacity of refrigeration system 10, and cause evaporator 20 to ice more quickly.

Variable $X_5$ is the pressure measurement in suction line 29 (FIG. 1) recorded during 'On' cycles of the refrigeration cycle. A statistical variance of the measurements is calculated during that On-time period. When evaporator 20 becomes iced, the pressures within suction line 29 become irregular due to expansion valve 22 being unable to properly maintain superheat at the outlet of evaporator 20. This instability can be measured at condenser 40 on suction line 29 coming from evaporator 20.

Variable $X_6$ is the temperature measurement in suction line 29 recorded during 'On' cycles of the refrigeration cycle. During each run cycle, the lowest measured temperature in suction line 29 is recorded. These measurements are used to calculate a temperature slope. When the resulting slope is slightly negative, evaporator 20 may be iced. When the slope has a large negative value, evaporator 20 is almost always iced up.

Upon powering up defrost control unit 50, microprocessor 88 (FIG. 3) begins recording the six variables $X_n$. At the start of a defrost cycle (e.g., time $t_0$; FIG. 2), extant values of variables $X_n$ are saved in memory. When the defrost cycle is complete (e.g., time $t_1$; FIG. 2), the defrost elapsed time (time interval $t_0$-$t_1$) is added to the previous data set record. By way of example and not by way of limitation, when ten refrigeration cycles (e.g., from start of pull down cycle 64 to end of defrost 70; time interval $t_1$-$t_4$; FIG. 2) have been recorded, a multiple linear regression may be performed on the data.

Figure 6:
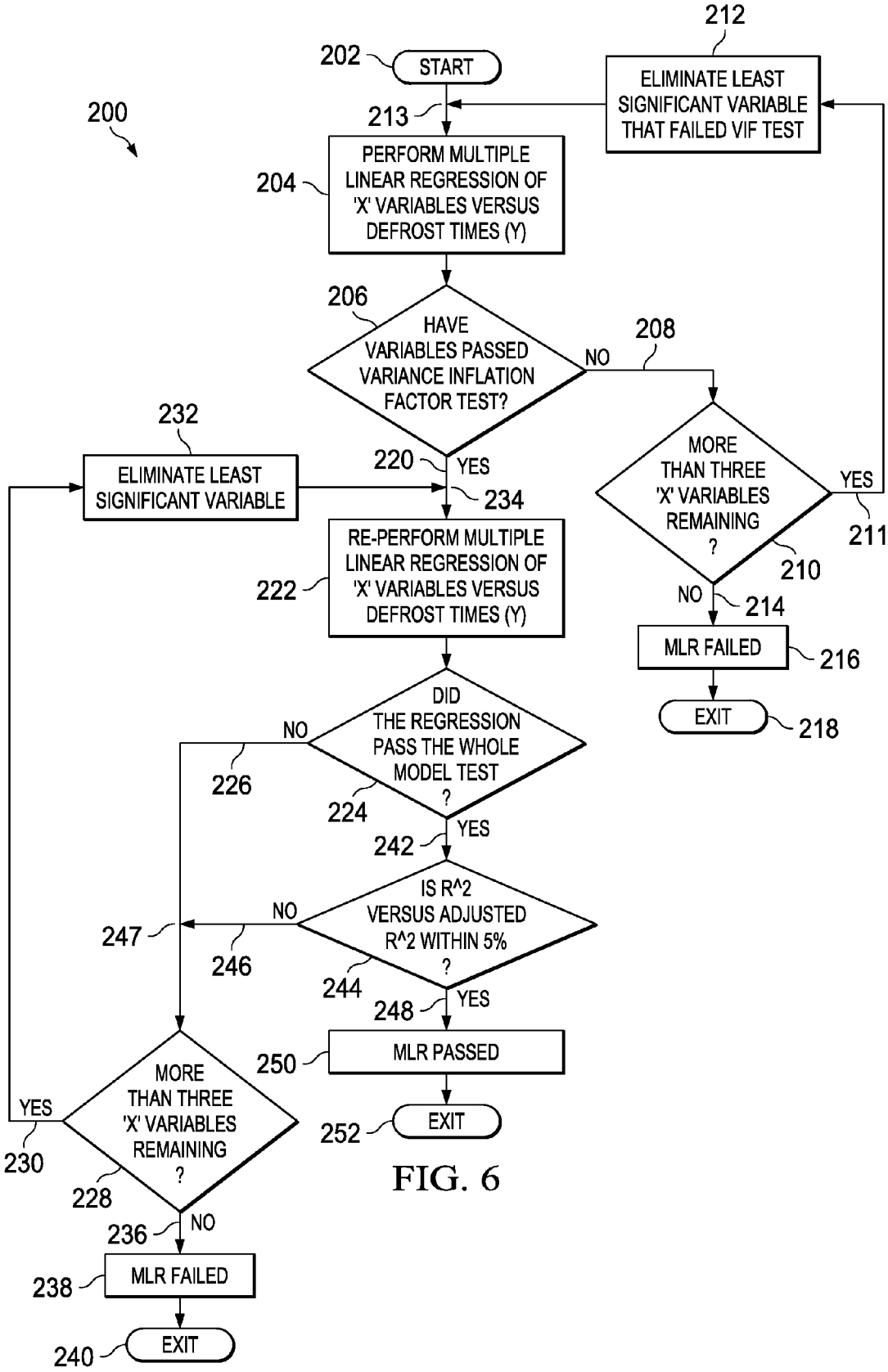
FIG. 6 is a flow chart illustrating a representative analysis of data useful for the method and apparatus of the present invention involving a multiple linear regression analysis.

FIG. 6 is a flow chart illustrating a representative analysis of data useful for the method and apparatus of the present invention involving a multiple linear regression analysis. In FIG. 6, a verifying process 200 for examining results of a multiple linear regression to determine if the results are valid begins at a START locus 202. Process 200 continues by performing a preliminary regression, as indicated by a block 204. Process 200 is carried out to determine whether X variables employed in the regression contain multi-colinearity. If multi-colinearity exists, the regression result is invalid. Process 200 continues by posing a query to individually examine X variables for a Variance Inflation Factor (VIF) of greater than a predetermined factor, such as by way of example and not by way of limitation a factor of 10, as indicated by a block 206. A respective X variable's having a VIF>10 would indicate that one of the other X variables has a correlation to the respective X variable by more than 90%. Once all of the X variables have been examined for VIF (block 206), if one or more has failed, process 200 proceeds according to NO response line 208 and a query is posed whether there are more than three X variables remaining, as indicated by a query block 210. If there are at least four X variables left, process 200 proceeds via YES response line 211, the respective X variable with the least statistical significance (using individual t statistics) is eliminated (as indicated by a block 212), process 200 returns to a process locus 213 and process 200 proceeds again as described in connection with blocks 204, 206. If the regression fails the VIF test (block 206) and only three variables are remaining, process 200 proceeds via NO response line 214, the regression test fails, as indicated by a block 216, and process 200 ends at an EXIT locus 218.

If all of the variables pass the VIF test (block 204), process 200 proceeds via YES response line 220 and re-performs the multiple linear regression with the remaining variables, as indicated by a block 222. Process 200 continues thereafter to pose a query whether the regression passed the whole model test, as indicated by a query block 224. The whole model test involves examining the F statistic for a minimum value. The minimum value is based upon an F statistic table that uses the number of variables and the number of observations to calculate a minimum value. If the regression result has an F statistic that is too low, process 200 proceeds via NO response line 226 and individual variables are examined to determine which has the least significance (using individual t statistics) to the resulting equation. A query is posed whether there are more than three variables left, as indicated by a query block 228. If there are more than three variables left, process 200 proceeds via YES response line 230 and the least significant variable is eliminated, as indicated by a block 232. Process 200 thereafter returns to a process locus 234 and process 200 proceeds again as described in connection with blocks 222, 224. If there are three variables or fewer left, process 200 proceeds via NO response line 236, the regression test fails, as indicated by a block 238, and process 200 ends at an EXIT locus 240.

If the regression result has an F statistic that is not too low, the whole model test passes, process 200 proceeds via YES response line 242 and the regression result is queried to determine whether the number of input variables being used in the regression is inflating the perceived percentage of variation accountability, as indicated by a query block 244. An $R^2$ calculation is employed to express the percentage of input variable variation that is not considered error. Increasing the number of input variables can artificially increase this percentage. By modifying the $R^2$ calculation to include the effect of the degrees of freedom available, an adjusted $R^2$ calculation is achieved. If the $R^2$ and the adjusted $R^2$ values are compared, the results should be within 5%, as indicated by query block 244. If the percentage difference between the $R^2$ and the adjusted $R^2$ values is greater than 5%, then one of the input variables is contributing too much error and must be eliminated, so process 200 proceeds via NO response line 246 to a process locus 247. Process 200 proceeds thereafter as described in connection with blocks 228, 232, 238, 240. If the percentage difference between the $R^2$ and the adjusted $R^2$ values is within 5%, then process 200 proceeds via YES response line, the regression test passes and the regression coefficients are recorded, as indicated by a block 250. Process 200 ends at an EXIT locus 252.

Figure 7:
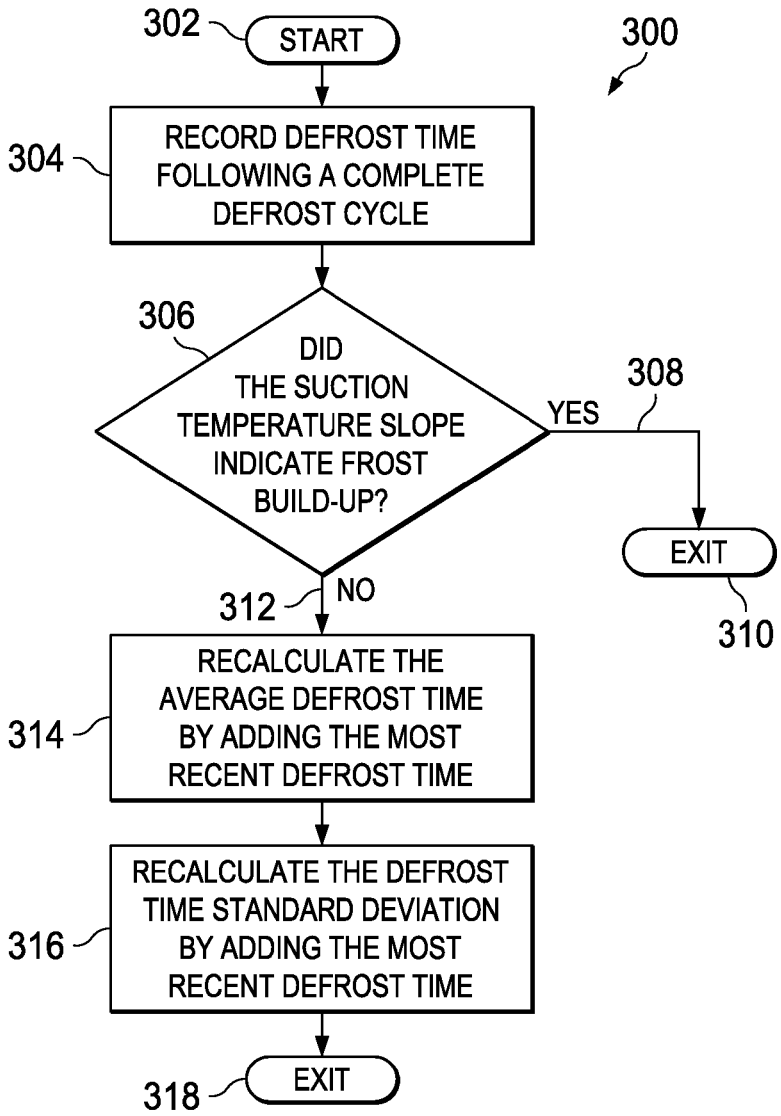
FIG. 7 is a flow chart illustrating representative additional steps useful for the method and apparatus of the present invention.

FIG. 7 is a flow chart illustrating representative additional steps useful for the method and apparatus of the present invention. In FIG. 7, a process 300 begins at a START locus 302 substantially at the end of each refrigeration cycle (from start of pull-down till end of defrost cycle; e.g., time interval $t_1$-$t_4$; FIG. 2). Process 300 continues by using the defrost controller unit 50 (FIG. 1) to record the time interval of the just-completed defrost cycle (e.g., defrost cycle 70; FIG. 2) and add the time interval to the data tables that are used to perform later regressions, as indicated by a block 304. While recording the defrost time, the slope of the suction temperature measurement from the same refrigeration cycle is examined to determine whether there is any evidence of frost build up during the cooling cycle, as indicated by a query block 306. Query block 306 poses a query whether slope of the suction temperature indicates frost buildup. Evidence of frost buildup is a negative slope value. If the suction temperature slope value for the refrigeration cycle is negative, then process 300 proceeds via YES response line 308 and process 300 ends at an EXIT locus 310. If the suction temperature slope value for the refrigeration cycle is positive or zero, then process 300 proceeds via NO response line 312 and the defrost time is added to a running defrost time mean calculation, as indicated by a block 314. A running defrost time standard deviation calculation is performed, as indicated by a block 316. Process 300 terminates thereafter at an EXIT locus 318.

The multiple linear regression calculations and the regression result testing (FIG. 6) are performed at the start of each pull down cycle (e.g., at times $t_1$, $t_4$: FIG. 2) for the data previously recorded. The exception to this is when the pull down cycle never completes.

Figure 8A:
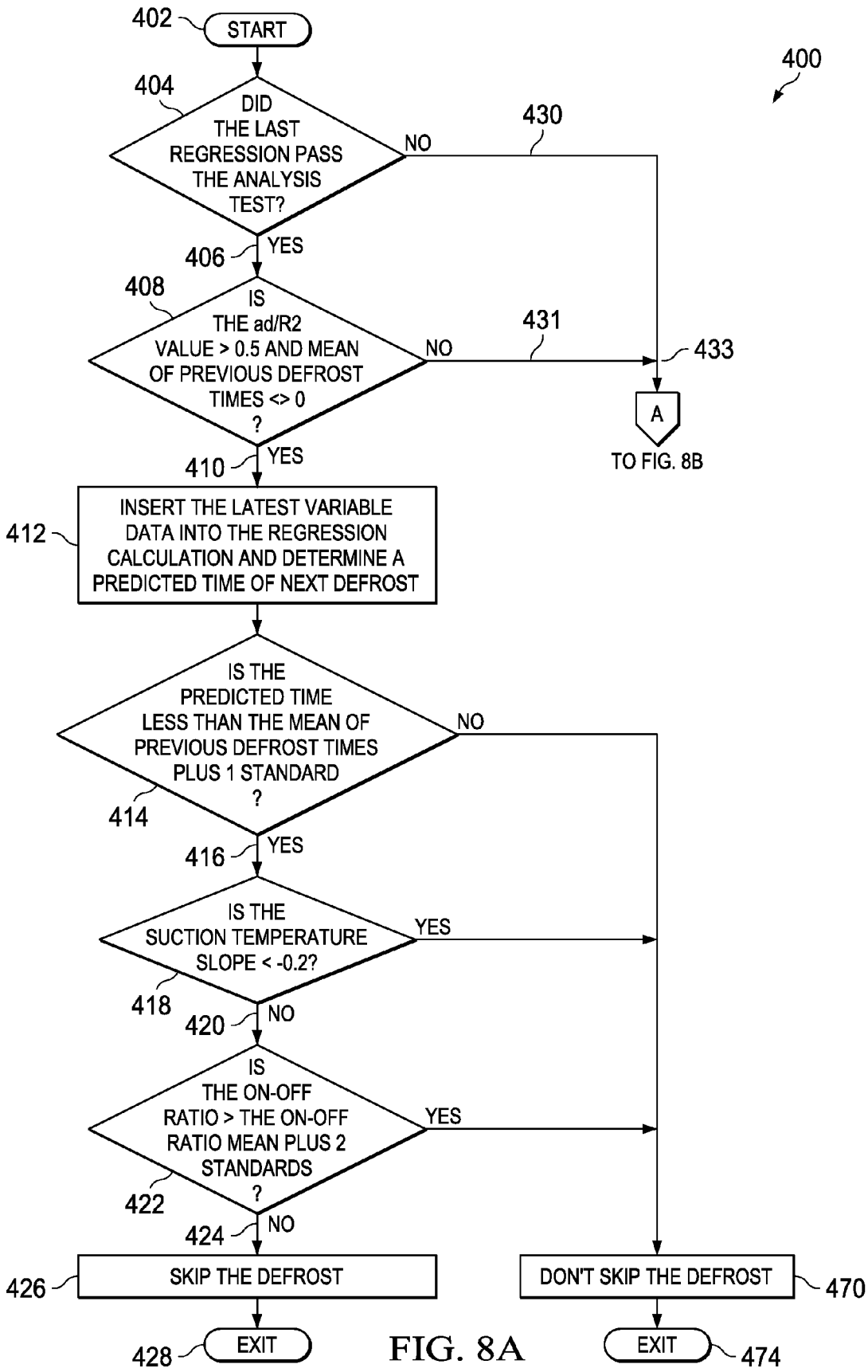
FIG. 8 is a flow chart illustrating representative further steps useful for the method and apparatus of the present invention.
Figure 8B:
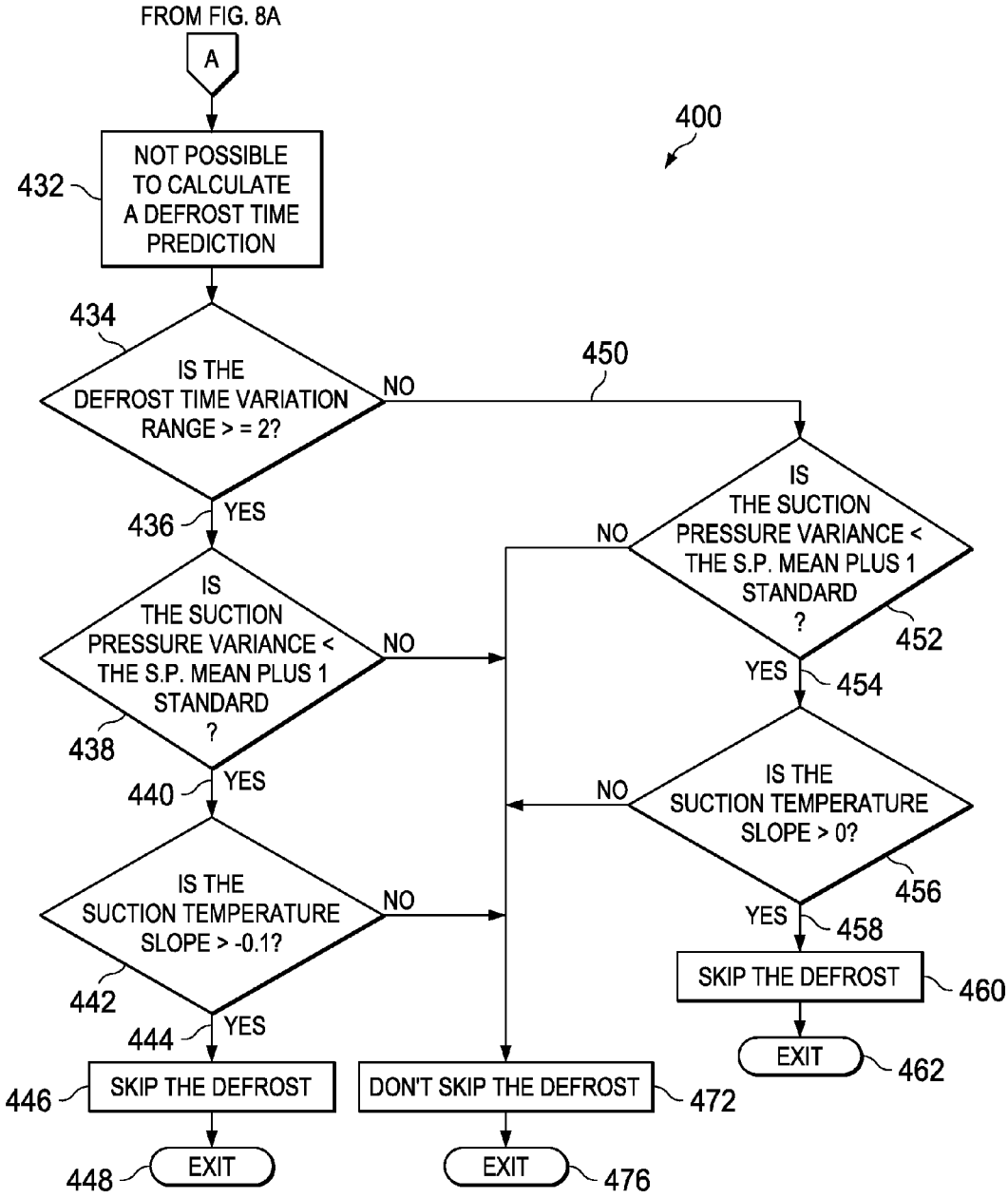

After a predetermined number of refrigeration cycles have been observed and recorded (by way of example and not by way of limitation, it is preferred that at least ten refrigeration cycles be observed and recorded), a multiple linear regression is performed at the end of the refrigeration cycle (from start of pull-down until end of defrost cycle (e.g., time interval $t_1$-$t_4$; FIG. 2). When the next defrost cycle starts, a decision is made regarding whether or not to skip the defrost cycle. FIG. 8 illustrates this decision process.

FIG. 8 is a flow chart illustrating representative further steps useful for the method and apparatus of the present invention. In FIG. 8, a process 400 begins at a START locus 402. Process 400 continues by posing a query whether the last regression analysis passed all of the statistical tests, as indicated by a query block 404. If the last regression analysis passed the tests, process 400 proceeds via YES response line 406 and queries are posed whether the adjusted $R^2$ value is greater than 0.5 and whether the mean value of the previous defrost times that did not indicate an iced evaporator is non-zero, as indicated by a block 408. The queries are preferable posed serially so that if the adjusted $R^2$ value is greater than 0.5, then the mean of the previous defrost times that did not indicate an iced evaporator is examined. If the mean value is non-zero, process 400 proceeds via YES response line 410 and the data recorded during the extant refrigeration cycle is inserted into the regression calculation to determine the predicted time of the next defrost cycle, as indicated by a block 412.

To correct for inaccuracies caused by data error, the standard error of the previous regression calculation is added to the prediction time. This corrected result is actually the largest value of a prediction range commonly referred to as the confidence interval. Process 400 continues by posing a query whether the corrected prediction time value is less than the previously calculated defrost cycle time mean (block 314; FIG. 7) plus one standard deviation (block 316; FIG. 7), as indicated by a query block 414. If the corrected prediction time value is less than the previously calculated defrost cycle time mean plus one standard deviation, process 400 proceeds via YES response line 416 and a query is posed whether the suction temperature slope from the current data is less than −0.2, as indicated by a query block 418. If the suction temperature slope from the current is not less than −0.2, then process 400 proceeds via NO response line 420. Process 400 continues by posing a query whether the On-Off ratio is greater than the mean of the On-Off ratio plus two standard deviations, as indicated by a query block 422. If the On-Off ratio is not greater than the mean of the On-Off ratio plus two standard deviations, process 400 proceeds via NO response line 424 and the extant defrost cycle is skipped, as indicated by a block 426. Process 400 then terminates at an EXIT locus 428.

If the last regression failed the statistical tests, process 400 proceeds from query block 404 via NO response line 430 to a process locus 433. A negative response to the query posed by query block 408 proceeds via NO response line 431 to process locus 433. Proceeding from process locus 433, process 400 cannot calculate a defrost time prediction, as indicated by a block 432. Process 400 continues by posing a query whether the range of the previous defrost times spans at least a 2-minute variation, as indicated by query block 434. If there is at least a two-minute variation in defrost times, process 400 proceeds via YES response line 436 and a query is posed whether the suction pressure variance of the current refrigeration cycle is less than the mean of the suction pressure variances plus one standard deviation, as indicated by a query block 438. If the current suction pressure variance is less than the mean plus one standard deviation, process 400 proceeds via YES response line 440 and a query is posed whether the current suction temperature slope is greater than −0.1, as indicated b a query block 442. If the current suction temperature slope is greater than −0.1, process 400 proceeds via YES response line 444 and the extant defrost cycle is skipped or terminated or truncated, as indicated by a block 446. Process 400 thereafter terminates at an EXIT locus 448.

If the last regression failed the statistical tests and the range of the previous defrost times is less than 2 minutes, process 400 proceeds via NO response line 450 from query block 434 and a query is posed whether the suction pressure variance of the current refrigeration cycle is less than the mean of the suction pressure variances plus one standard deviation, as indicated by a query block 452. If the current suction pressure variance is less than the mean of the suction pressure variances plus one standard deviation, process 400 proceeds via YES response line 454 and a query is posed whether the current suction temperature is greater than zero, as indicated by a query block 456. If the current suction temperature is greater than zero, process 400 proceeds via YES response line 458 and the extant defrost cycle is skipped or terminated or truncated, as indicated by a block 460. Process 400 thereafter terminates at an EXIT locus 462. When a defrost cycle is skipped, the data recording continues. The data gathered from the thus-elongated cycle is used in the next succeeding regression calculation.

NO responses to queries posed by query blocks 414, 438, 442, 452, 456 will not skip or terminate or truncate an extant defrost cycle, as indicated by blocks 470, 472 and process 400 thereafter terminates at an exit locus 474, 476. When a defrost cycle is skipped, the data recording continues. The data gathered from the elongated cycle is used in the next regression calculation. YES responses to queries posed by query blocks 418, 422 will not skip or terminate or truncate an extant defrost cycle, as indicated by block 470 and process 400 thereafter terminates at an exit locus 474.

After a predetermined number of recorded cycles, (e.g., by way of example and not by way of limitation, thirty recorded cycles), the oldest data is discarded when a next data set becomes available. This provision leaves only the latest thirty cycles in each succeeding regression calculation data set.

It is to be understood that, while the detailed drawings and specific examples given describe preferred embodiments of the invention, they are for the purpose of illustration only, that the apparatus and method of the invention are not limited to the precise details and conditions disclosed and that various changes may be made therein without departing from the spirit of the invention which is defined by the following claims:

We claim:

1. A method for affecting a scheduled defrost operation for a refrigeration system; said scheduled defrost operation being initiated at a scheduled defrost commencement time by a defrost time clock in said refrigeration system; the method comprising the steps of:

(a) adding a discrete defrost control unit coupled with said defrost time clock;

(b) before said scheduled defrost commencement time, operating said discrete defrost control unit to effect evaluating at least one predetermined parameter relating to past operation of said refrigeration system;

(c) if said at least one predetermined parameter manifests a behavior of at least one first predetermined nature over at least one first time interval, operating said discrete defrost control unit to permit said scheduled defrost operation; and (d) if said at least one predetermined parameter manifests a behavior of at least one second predetermined nature over at least one second time interval, operating said discrete defrost control unit to preempt commencement of said scheduled defrost operation.

2. The method for affecting a scheduled defrost operation for a refrigeration system as recited in claim 1 wherein said at least one predetermined parameter includes data collected during or after at least one past completed defrost operation.

3. The method for affecting a scheduled defrost operation for a refrigeration system as recited in claim 2 wherein said data is subjected to an analysis for ascertaining said behavior of said at least one predetermined parameter; said behavior being measured as at least one trend in said at least one predetermined parameter.

4. The method for affecting a scheduled defrost operation for a refrigeration system as recited in claim 3 wherein said analysis includes a regression analysis and wherein said data includes at least two of total cycle time of said refrigeration system, pull-down time of said refrigeration system, on-off ratio of said refrigeration system, ambient temperature in a space cooled by said refrigeration system, suction pressure in said refrigeration system and suction temperature in said refrigeration system.

5. The method for affecting a scheduled defrost operation for a refrigeration system as recited in claim 1 wherein said refrigeration system includes a compressor contactor unit controlling operation of a compressor and includes at least one sensor indicating said at least one predetermined parameter; and wherein said discrete defrost control unit is further coupled with said compressor contactor unit and said at least one sensor.

6. The method for affecting a scheduled defrost operation for a refrigeration system as recited in claim 3 wherein said refrigeration system includes a compressor contactor unit controlling operation of a compressor and includes at least one sensor indicating said at least one predetermined parameter; and wherein said discrete defrost control unit is further coupled with said compressor contactor unit and said at least one sensor.

7. The method for affecting a scheduled defrost operation for a refrigeration system as recited in claim 4 wherein said refrigeration system includes a compressor contactor unit controlling operation of a compressor and includes at least one sensor indicating said at least one predetermined parameter; and wherein said discrete defrost control unit is further coupled with said compressor contactor unit and said at least one sensor.

8. A method for affecting defrost operations for a refrigeration system; said defrost operations being periodically initiated by a defrost time clock in said refrigeration system; the method comprising the steps of:

(a) providing a discrete defrost control unit coupled with said refrigeration system;

(b) operating said discrete defrost control unit to effect collecting data during or between successive defrost operations of said refrigeration system as collected data;

(c) saving at least a portion of said collected data as saved data;

(d) before commencement of a defrost operation, operating said discrete defrost control unit to effect evaluating at least a portion of said saved data as evaluated data;

(e) if said evaluated data manifests a behavior of at least one first predetermined nature over at least one first predetermined time interval, operating said discrete defrost control unit to permit said defrost operation; and (f) if said evaluated data manifests a behavior of at least one second predetermined nature over at least one second predetermined time interval, operating said discrete defrost control unit to preempt said defrost operation;

wherein said evaluated data relates to past operation of said refrigeration system.

9. The method for affecting defrost operations for a refrigeration system as recited in claim 8 wherein said evaluated data is subjected to an analysis for ascertaining said behavior of said evaluated data; said behavior being measured as at least one trend in said evaluated data.

10. The method for affecting defrost operations for a refrigeration system as recited in claim 9 wherein said analysis includes a regression analysis and wherein said evaluated data includes at least one of total cycle time of said refrigeration system, pull-down time of said refrigeration system, on-off ratio of said refrigeration system, ambient temperature in a space cooled by said refrigeration system, suction pressure in said refrigeration system and suction temperature in said refrigeration system.

11. A discrete apparatus configured for coupling with a refrigeration system for affecting defrost operations for said refrigeration system; said defrost operations being periodically initiated by a defrost time clock in said refrigeration system; the apparatus comprising:

(a) a data collection and storage unit coupled with said refrigeration system; said data collection and storage unit acquiring collected data from said refrigeration system during or after successive defrost operations of said refrigeration system; said data collection and storage unit storing at least a portion of said collected data as stored data;

(b) an evaluation unit coupled with said data collection and storage unit; said evaluation unit operating before a next-scheduled said defrost operation commences to effect evaluation of at least one predetermined aspect of at least a portion of said stored data relating to operation of said refrigeration system; and (c) a control unit coupled with said evaluation unit and coupled with said refrigeration system; said control unit cooperating with said refrigeration system to effect permitting said next-scheduled defrost operation if said at least one predetermined aspect of said stored data manifests a behavior of at least one first predetermined nature over at least one first time interval; said control unit cooperating with said refrigeration system to effect preempting said next-scheduled defrost operation if said at least one predetermined aspect of said stored data manifests a behavior of at least one second predetermined nature over at least one second time interval;

wherein said evaluated data relates to past operation of said refrigeration system.

12. The discrete apparatus configured for coupling with a refrigeration system for affecting defrost operations for said refrigeration system as recited in claim 11 wherein said at least one predetermined parameter includes elapsed time since a most recent past completed defrost operation.

13. The discrete apparatus configured for coupling with a refrigeration system for affecting defrost operations for said refrigeration system as recited in claim 11 wherein said at least one predetermined parameter includes data collected during or after at least one past completed defrost operation.

14. The discrete apparatus configured for coupling with a refrigeration system for affecting defrost operations for said refrigeration system as recited in claim 13 wherein said data is subjected to an analysis for ascertaining said behavior of said at least one predetermined parameter; said behavior being measured as at least one trend in said at least one predetermined parameter.

15. The discrete apparatus configured for coupling with a refrigeration system for affecting defrost operations for said refrigeration system as recited in claim 14 wherein said analysis includes a regression analysis and wherein said data includes at least two of total cycle time of said refrigeration system, pull-down time of said refrigeration system, on-off ratio of said refrigeration system, ambient temperature in a space cooled by said refrigeration system, suction pressure in said refrigeration system and suction temperature in said refrigeration system.

16. The discrete apparatus configured for coupling with a refrigeration system for affecting defrost operations for said refrigeration system as recited in claim 11 wherein refrigeration system includes a compressor contactor unit controlling operation of a compressor and includes at least one sensor indicating said collected data; and wherein the discrete apparatus is coupled with said defrost time clock, said compressor contactor unit and said at least one sensor.

17. The discrete apparatus configured for coupling with a refrigeration system for affecting defrost operations for said refrigeration system as recited in claim 13 wherein said refrigeration system includes a compressor contactor unit controlling operation of a compressor and includes at least one sensor indicating said collected data; and wherein the discrete apparatus is coupled with said defrost time clock, said compressor contactor unit and said at least one sensor.

18. The discrete apparatus configured for coupling with a refrigeration system for affecting defrost operations for said refrigeration system as recited in claim 14 wherein said refrigeration system includes a compressor contactor unit controlling operation of a compressor and includes at least one sensor indicating said collected data; and wherein the discrete apparatus is coupled with said defrost time clock, said compressor contactor unit and said at least one sensor.

19. The discrete apparatus configured for coupling with a refrigeration system for affecting defrost operations for said refrigeration system as recited in claim 15 wherein said refrigeration system includes a compressor contactor unit controlling operation of a compressor and includes at least one sensor indicating said collected data; and wherein the discrete apparatus is coupled with said defrost time clock, said compressor contactor unit and said at least one sensor.

* * * * *